US011118388B2

(12) United States Patent
Terno

(10) Patent No.: US 11,118,388 B2
(45) Date of Patent: Sep. 14, 2021

(54) SLIDING AND BRAKING DEVICE FOR SLIDING DOORS AND SHUTTERS

(71) Applicants: TERNO SCORREVOLI S.P.A. UNIPERSONALE, Varedo (IT); Nicola Ballotta, Marano sul Panaro (IT)

(72) Inventor: Giovanni Terno, Varedo (IT)

( * ) Notice: Subject to any disclaimer, the term of this patent is extended or adjusted under 35 U.S.C. 154(b) by 0 days.

(21) Appl. No.: 16/340,560

(22) PCT Filed: Jan. 17, 2018

(86) PCT No.: PCT/EP2018/000024
§ 371 (c)(1),
(2) Date: Apr. 9, 2019

(87) PCT Pub. No.: WO2018/137885
PCT Pub. Date: Aug. 2, 2018

(65) Prior Publication Data

US 2020/0157868 A1 May 21, 2020

(30) Foreign Application Priority Data

Jan. 27, 2017 (IT) ..... 102017000008876

(51) Int. Cl.
*E05F 5/00* (2017.01)
*E05F 1/16* (2006.01)
*E05D 15/06* (2006.01)

(52) U.S. Cl.
CPC ..... *E05F 5/003* (2013.01); *E05F 1/16* (2013.01); *E05D 15/063* (2013.01);
(Continued)

(58) Field of Classification Search
CPC ... E05F 5/003; E05F 5/02; E05F 5/027; E05F 1/16; E05D 15/063
See application file for complete search history.

(56) References Cited

U.S. PATENT DOCUMENTS

2016/0201368 A1* 7/2016 Haab ..... E05D 3/04 16/103
2019/0360247 A1* 11/2019 Terno ..... E05F 5/003
2020/0224473 A1* 7/2020 Terno ..... E05D 15/063

FOREIGN PATENT DOCUMENTS

DE 102008061728 A1 6/2010
DE 202012002884 U1 6/2013
(Continued)

OTHER PUBLICATIONS

International Search Report, dated Jul. 9, 2018 for corresponding PCT patent application No. PCT/EP2018/000024.
(Continued)

*Primary Examiner* — Gregory J Strimbu
(74) *Attorney, Agent, or Firm* — Abelman, Frayne & Schwab; Stefan Knirr

(57) ABSTRACT

A device for sliding and braking a sliding door includes a profile fastened to an inside of the sliding door, and two damper stops arranged on a base portion of the profile at opposite ends of the profile and offset relative to each other in a direction perpendicular to the inside of the sliding door. Each damper stop includes a piston and a coil spring housed in a frame, and a pivoting slider slidably supported in the frame and connected to the piston and the coil spring. The device further includes a wall support for supporting the door on a wall via engagement of wheels provided on the support in an upper guide portion of the profile. The support has appendages arranged so that a respective one of the appendages actuates the pivoting slider of one of the two damper stops when opening and closing the sliding door.

5 Claims, 9 Drawing Sheets

(52) U.S. Cl.
CPC ..... *E05Y 2201/41* (2013.01); *E05Y 2800/24* (2013.01); *E05Y 2900/132* (2013.01)

(56) References Cited

FOREIGN PATENT DOCUMENTS

| | | | | |
|---|---|---|---|---|
| DE | 10 2018 112 026 | | * | 11/2019 |
| EP | 2 330 268 | | * | 7/2016 |
| WO | 2012073215 | A1 | | 6/2012 |
| WO | WO 2015/121272 | | * | 8/2015 |
| WO | WO 2019/158265 | | * | 8/2019 |

OTHER PUBLICATIONS

Written Opinion of the International Search Authority, dated Jul. 9, 2018 for corresponding PCT patent application No. PCT/EP2018/000024.

* cited by examiner

SLIDING AND BRAKING DEVICE FOR SLIDING DOORS AND SHUTTERS

CROSS REFERENCE TO RELATED APPLICATIONS

This application is a national phase of PCT application No. PCT/EP2018/000024, filed Jan. 17, 2018, which claims priority to IT patent application No. 102017000008876, filed Jan. 27, 2017, all of which are incorporated herein by reference thereto.

BACKGROUND OF THE INVENTION

The present invention relates to a sliding and braking device for sliding doors and shutters. More in particular, the present invention relates to a device as defined above suitable to allow an effective improvement of the braking effect of traditional damper stops which slow down the movement of the door or shutter both in the opening and closing phases.

It is known that sliding doors, especially for closing the passage between two adjacent rooms, are connected with specific devices that ensure adequate sliding of the sliding doors during opening and closing. Such devices comprise an upper guide fixed to the wall, for the sliding of one or more carriages provided with an appendage protruding downward from said guide and connected to the upper end of the door; a complementary lower guide is integrated flush with the floor in which wheels or rollers connected to the bottom edge of the door slide. A solution of this kind is described in the patent application EP 2 913 468 A1 by the same applicant.

According to another known and widespread solution by the same applicant, typically used for realising sliding doors projecting from the wall, an upper guide consisting of a shaped profile is fixed to the door to be moved at or near its top edge; in the aforementioned profile opposite damper stops are housed aligned longitudinally with each other, consisting of a gas piston cooperating with a coil spring. During the opening and closing movement of the door, the damper stops are alternately in contact with an actuator, consisting of an appendage projecting from the central part of a carriage fixed to the wall provided with wheels to facilitate the sliding of the shaped section. The known damper stops may however perform a limited and very short stroke, approximately 30 mm, since the overall dimensions defined by the exposure of the stem of both opposite pistons cannot exceed the overall longitudinal extension of the body on which said pistons are arranged in alignment. This causes a significant limitation of the progressive braking effect on the door, both during opening and closing.

WO 2012/073215 discloses the solution of making a sliding door provided with guide and support means having a very limited dimension with respect to the extension of the opening to be shielded; said door comprises rotating members with at least one idler wheel, with longitudinal guide members comprising a section with a rail extending in a direction parallel to the direction of translation of the shutter. DE 10 2008 061728 concerns a sliding door with a shutter suspended from least one carriage and guided so as to slide along a rail positioned on the wall or ceiling.

DE 20 2012 002884 refers to a damper to mitigate the relative movement of the moving parts of a device and comprises two clamping members.

SUMMARY OF THE INVENTION

The purpose of the present invention is to overcome the drawback above referred to above.

More specifically, the purpose of the present invention is to provide a sliding and braking device for sliding doors and shutters in which the damper stops can perform a complete stroke as regards the exposure of the stem of the opposite pistons, all to the advantage of the effective and progressive braking of the door, both during opening and closing.

A further aim of the invention is to provide a sliding and braking device for sliding doors and shutters as defined above in which both the stems of opposite pistons can be exposed entirely, avoiding in any case exceeding the overall longitudinal extension of the body on which said pistons are arranged.

A further purpose of the invention is to make available to users a sliding and braking device for sliding doors and shutters suitable to ensure a high level of resistance and reliability over time, in addition such as to be easily and economically made.

These and other purposes are achieved by the sliding and braking device for sliding doors of the present invention according to the main claim.

BRIEF DESCRIPTION OF THE DRAWING

The construction and functional characteristics of the sliding and braking device for sliding doors and shutters of the present invention will be more clearly comprehensible from the detailed description below in which reference is made to the appended drawings which show a preferred and non-limiting embodiment and wherein.

DETAILED DESCRIPTION OF PREFERRED EMBODIMENTS

Figure 1:
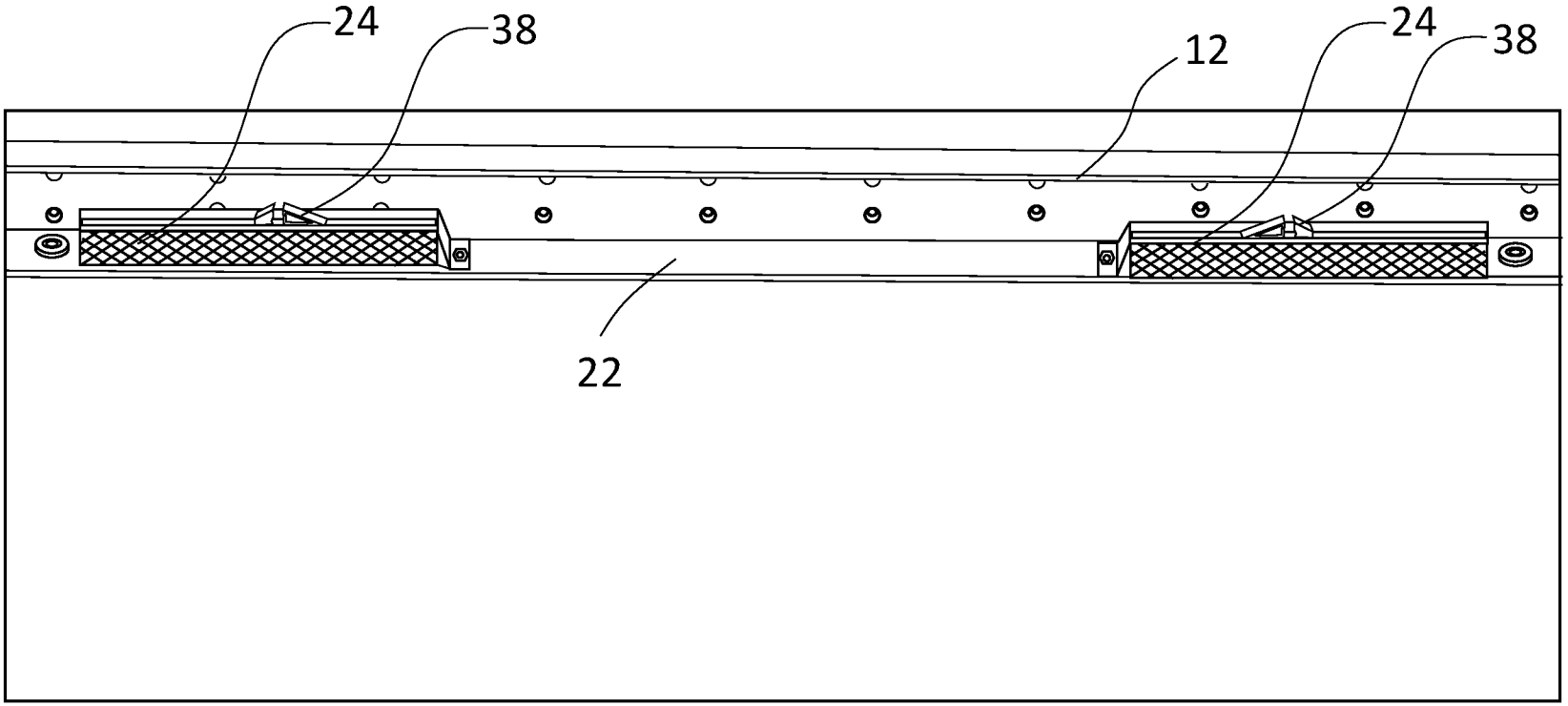
FIG. 1 represents schematically an axonometric view of the upper guide, consisting of a shaped profile fixed to the door to be moved on which opposite supports are arranged comprising respective damper stops according to the invention.
Figure 2:
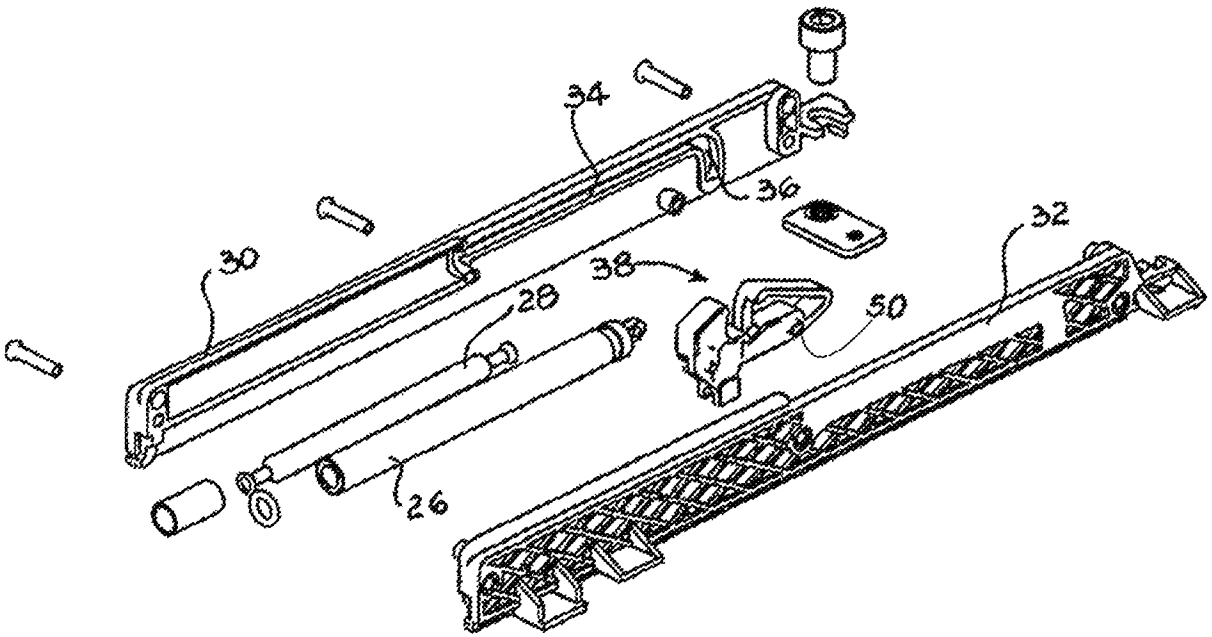
FIG. 2 represents schematically an exploded view of one of the supports comprising the damper stop.
Figure 5:
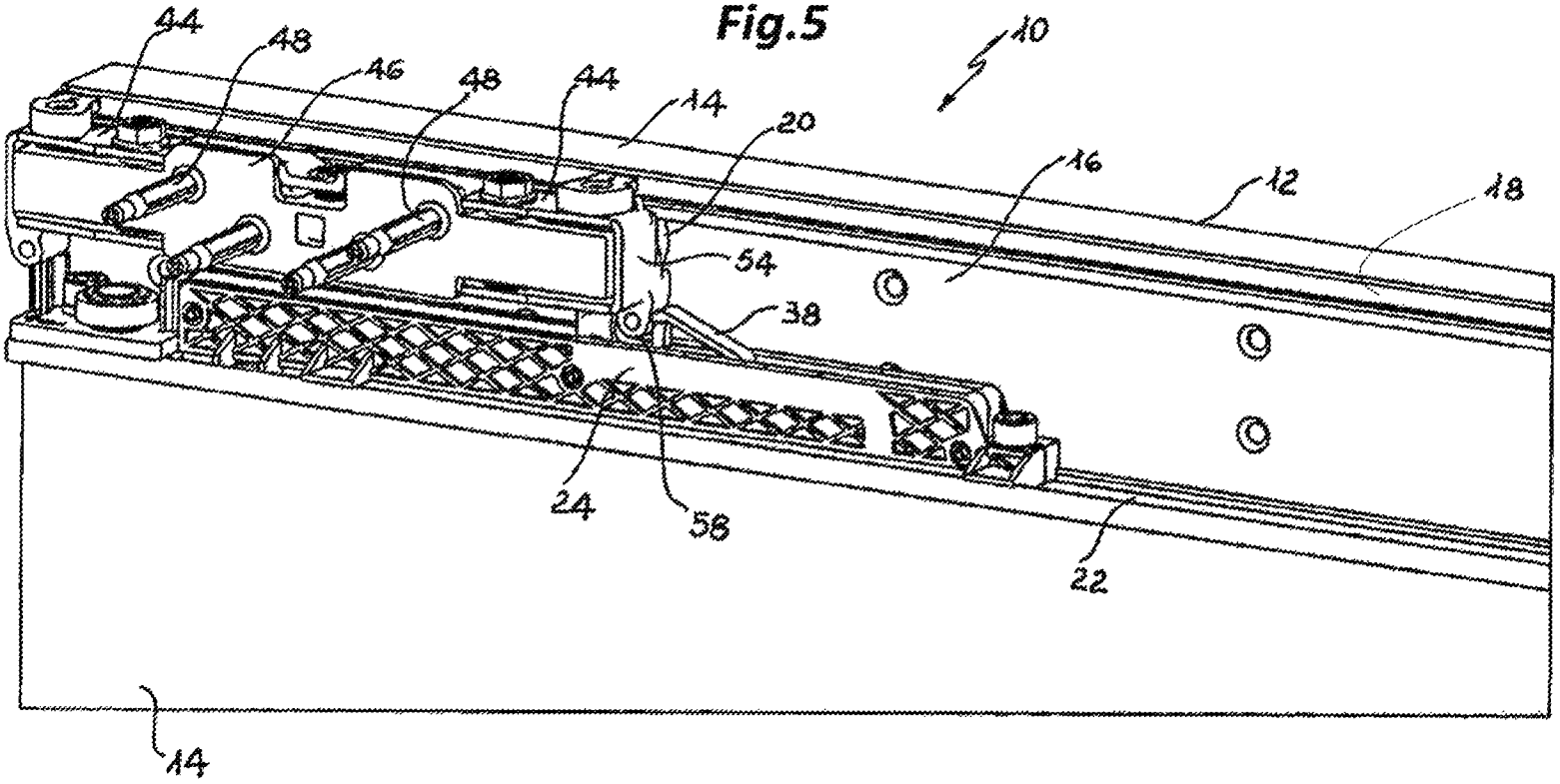
FIG. 5 represents schematically a partial axonometric view of the inner face of one end of the door to be moved according to a different angle from the one in FIG. 3.
Figure 6:
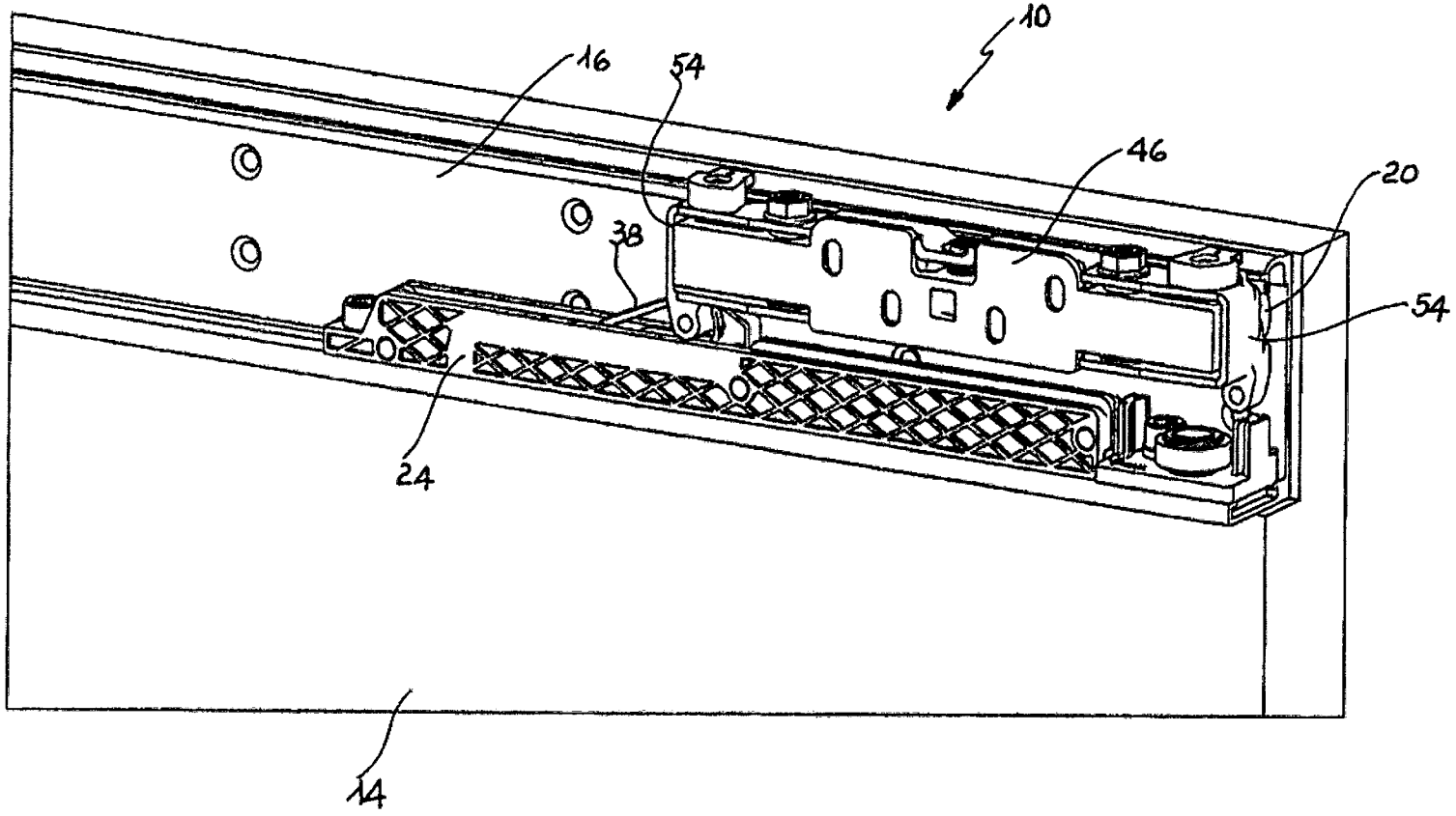
FIG. 6 represents schematically a partial axonometric view of the inner face of the opposite end of the door to be moved according to a different angle from the one in FIG. 4.
Figure 7:
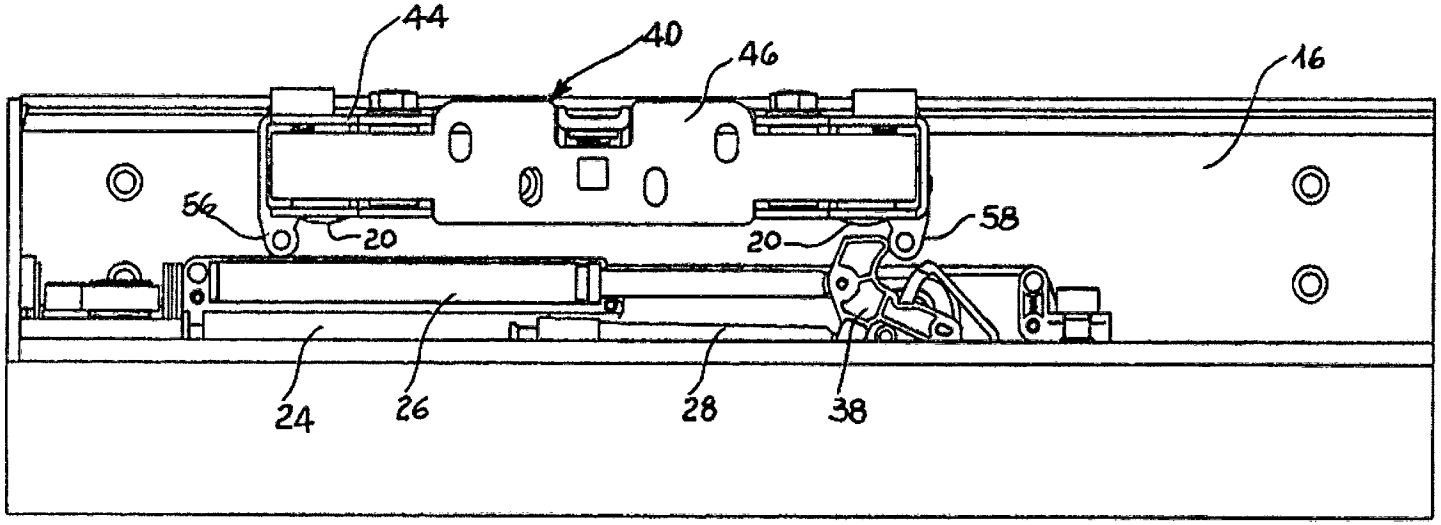
FIG. 7 represents schematically a frontal schematic view of the device of the invention, to highlight the damper stop placed at one end of the shaped profile fixed to the door to be moved.
Figure 8:
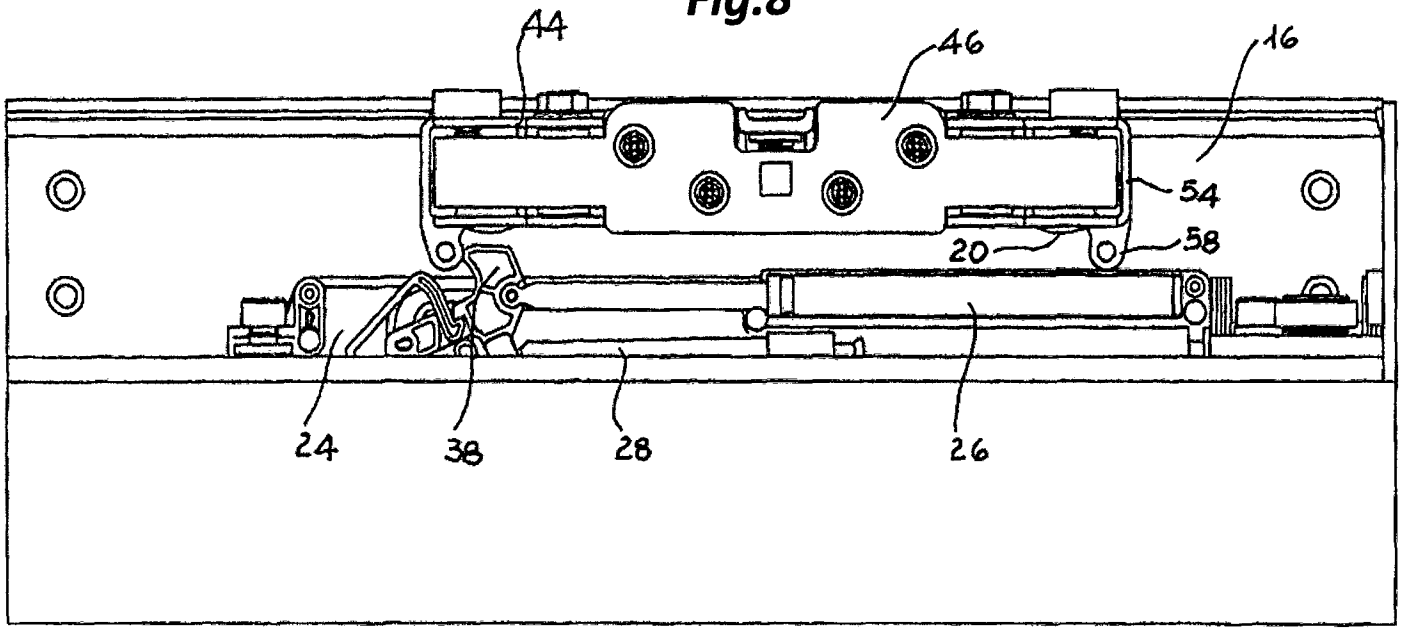
FIG. 8 represents schematically a frontal schematic view of the device of the invention, to highlight the damper stop placed at the opposite end of the shaped profile fixed to the door to be moved.

With initial reference to FIGS. 1 and 2, the device for the sliding and braking of sliding doors and shutters of the invention, globally denoted by reference numeral 10 in FIGS. 5 and 6, comprises a profile 12 made of metal or other suitable material having a substantially "C" shaped cross-section, in this case, it is fixed with screws or equivalent means to the inner face of the door to be moved, indicated by reference numeral 14, flush with the top edge of said door. The vertical portion 16 of the profile 12 thus adheres to the inner face of the door 14. The upper portion 18 of said profile extends cantilevered horizontally in the direction away from the door 14 and then bends downwards to a limited extent, forming an inverted "U" seat constituting the sliding guide or rail 19 for one or more wheels 20 described further below. The opposite lower branch or base portion 22 of the profile 12 extends cantilevered horizontally away from the door 14 to a greater extent than the upper portion 18 and defines a longitudinally extending flat surface on which opposite damper stops 24, known per se, are fixed. As shown in FIG. 2, each of said damper stops comprises an air or gas piston 26 and a coil spring 28, housed and positioned above one another in a frame formed by a snap or pressure coupling of two plate-shaped elements 30, 32; each including a groove 34, having a downward bend 36 at one end of the frame, along which the known pivoting slider 38 is slidingly guided by a protruding pawl 50 provided on the slider. The slider 38 is intended to be engaged by and driven by an actuator described below, which leads said slider to compress or load the coil spring 28 and at the same time abut the exposed stem of the piston 26.

According to the invention, the opposing damper stops 24 fixed along the lower branch or base portion 22 of the profile 12, intended to slow down the excursion of the door 14 in opening or closing, are offset relative to each other as may be seen in FIG. 1; as shown in FIG. 1, it is in fact clear that one of the damper stops 24, particularly the one shown on the left side of the drawing, is positioned on the base portion 22 near the vertical portion 16 of the profile 12, while the opposite damper stop 24, shown on the right side of the same drawing, is positioned along the outermost part of the base portion 22 and distant from the vertical portion 16. The respective pivoting sliders 38 integrated in the opposite damper stops 24 are therefore also offset relative to each other; said pivoting sliders 38 may be constrained with any means to the lower branch or base portion 22 of the profile 12.

Figure 9:
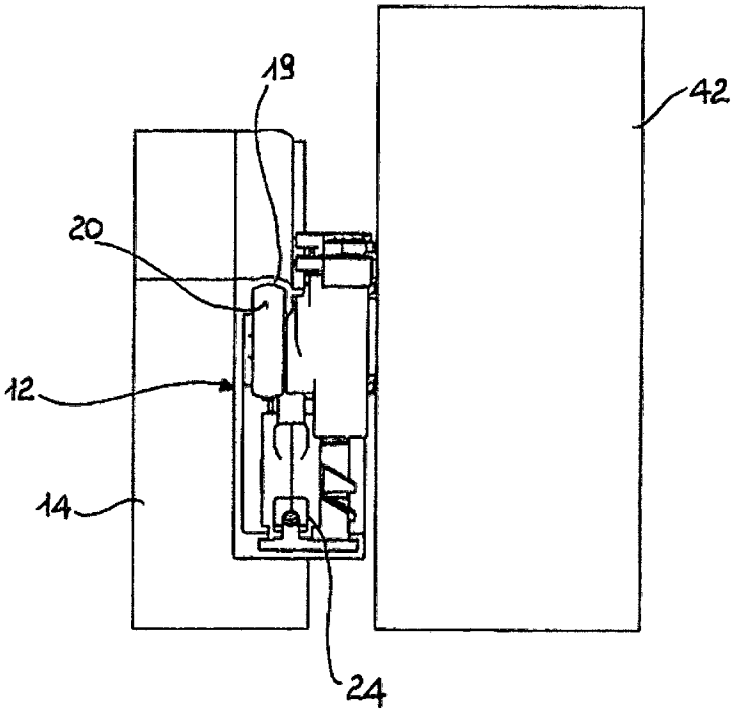
FIG. 9 represents schematically a front view of the device of the invention placed between the sliding door and the wall on which the sliding door is mounted.

The damper stops 24 fixed to the base portion 22 of the profile 12 and offset relative to each other are destined to cooperate with a support 40 suitably fixed to the wall behind the door 14 denoted by 42 in FIG. 9, and above the opening destined to be screened or made available, in whole or in part, by effect of the sliding open or closed of said door. The wall support 40 comprises by way of example with reference to FIGS. 3, 4, 5 a substantially rectangular perimetral reinforcement 44, which and a shaped plate 46 destined to be fastened with anchor plugs 48 to the wall 42. The front part of each wall support 40 facing the profile 12 is provided with at least one of the aforementioned wheels 20, preferably two paired, idly rotating wheels 20, intended to engage in the guide portion 19 of the profile. In practice, the door 14 is opened connected to the support 40 by the wheels 20 which engage in the guide portion 19 and allow the sliding of said door; along the floor, instead, said door rests and slides in a known manner on one or more wheels or bearings, engaged in a guide mounted flush with the floor. The rectangular reinforcement 44 comprises opposite vertical sides 54, at the lower end of which respective bevelled appendages 56, 58 are provided, destined to engage with the pivoting slider 38 of one of the damper stops 24; the bevelled appendages 56 and 58 project downwardly from the wall support 40 and act as actuators of the pivoting sliders 38 which, during opening or closing of the sliding door 14, compress the coil spring 28 or piston stem of piston 26.

Figure 3:
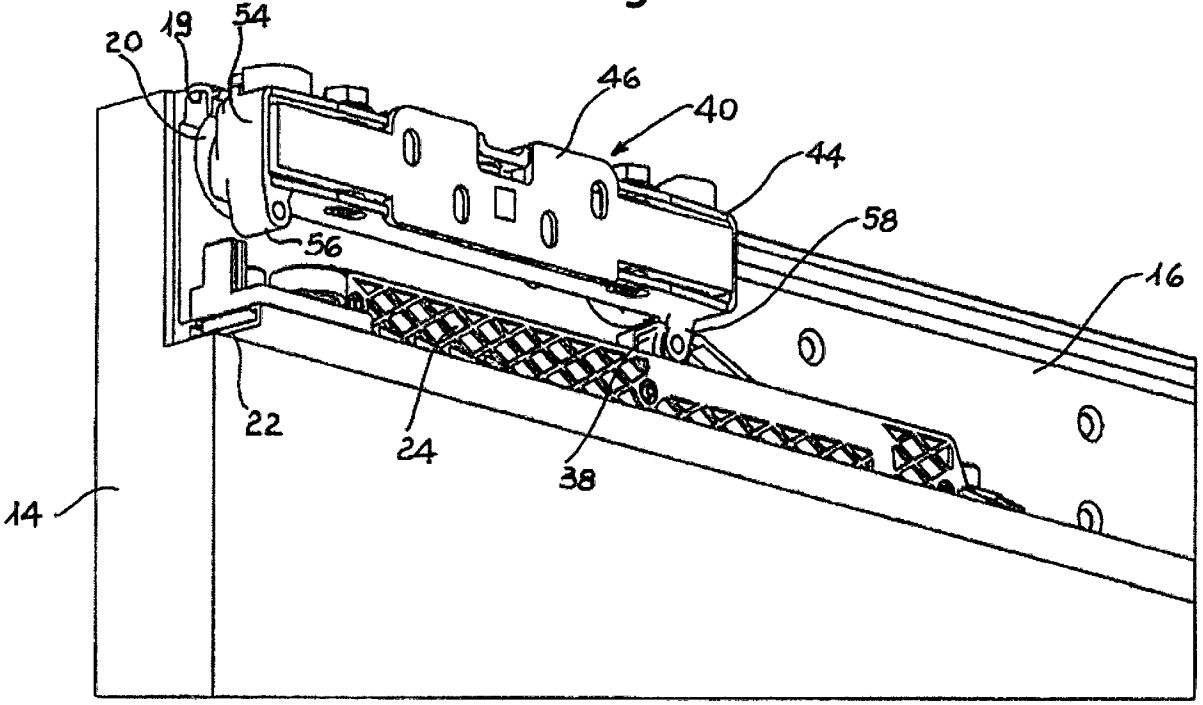
FIG. 3 schematically shows a partial axonometric view of the inner face of one end of the door to be moved, highlighting the shaped profile, one of the damper stops and one of the supports along which said profile slides.
Figure 4:
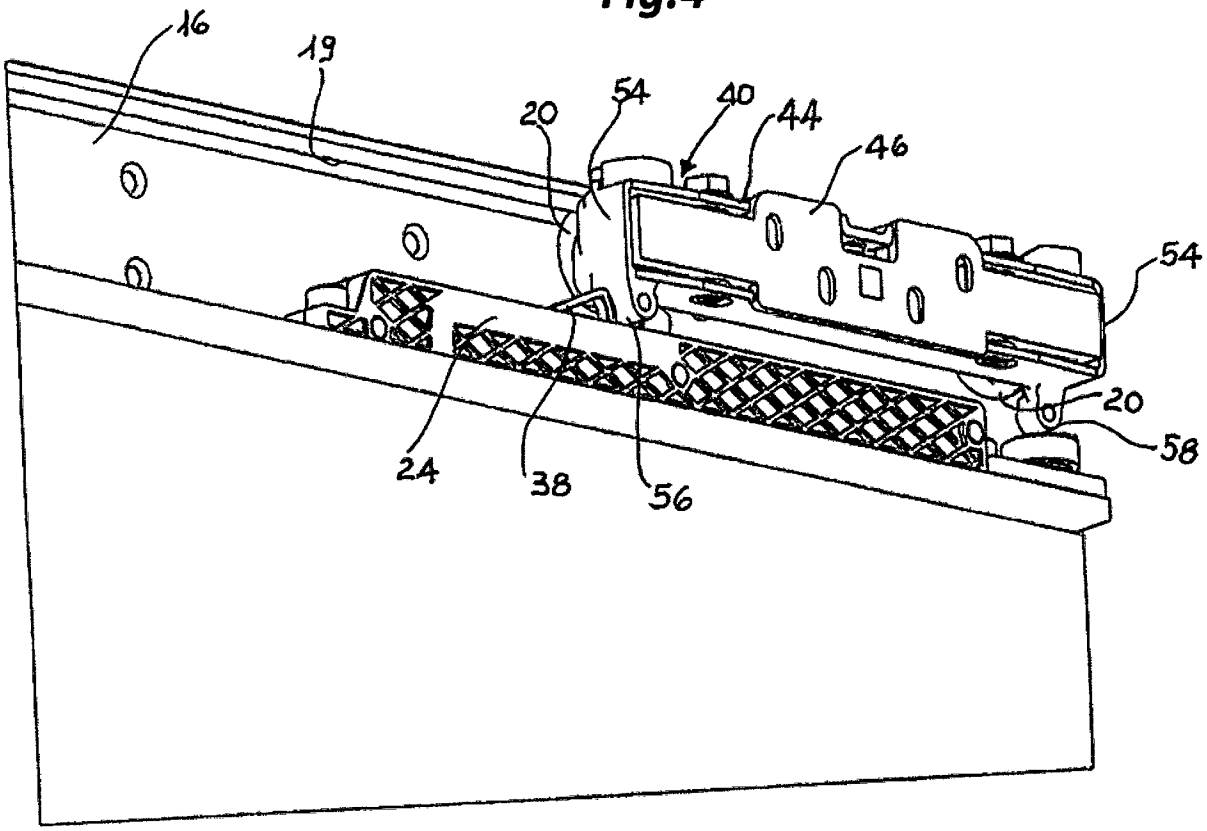
FIG. 4 represents schematically a partial axonometric view of the inner face of the opposite end of the door to be moved, highlighting the same shaped profile, one of the damper stops and one of the supports along which said profile slides.

In order to adapt to the offset of the damper stops 24 fixed to the profile 12, hence to the resulting offset of the pivoting sliders 38, the bevelled appendages 56 and 58 provided at the lower end of opposites vertical sides of the reinforcement 44 of the wall support 40 are correspondingly offset, as can be seen in particular from FIGS. 3 and 4.

Given the offset of the damper stops 24 fixed to the base portion 22 of the profile section 12, the stem of the pistons 26 of both damper stops can freely extend completely and unobstructed, while remaining in any case inside the maximum extension of the damper stops the same being true for the coil spring 28. As a result, when the door 14 is pushed open or closed, even abruptly, the fully exposed piston stem ensures the adequate and progressive braking of the door. Compared to previous known solutions, where the stroke of the stem of each piston 26 could be about 30 mm, according to the invention it can be much greater and reach up to 60 mm.

In detail, during the opening or closing of the sliding door 14, one of the bevelled appendages 56 or 58 engages with the pivoting slider, causing the pivoting slider to partially rotateand slide in the groove 34 via the projecting pawl 50 and abuts both the stem of the piston 26 and the coil spring 28; the previously fully extended spring is compressed and loaded contributing to the progressive braking of the door 14, while at the same time the entirely exposed stem of the piston 26 progressively moves rearwards achieving the complete and gradual braking of the door. If, during the opening phase of the door 14 the bevelled appendage 56 of the wall support 40 couples for example the pivoting slider 38 of the damper stop placed outermost on the profile 12, in the closing phase, i.e. when the sliding direction of the door 14 is inverted, the bevelled appendage 58 of the wall support 40 engages with the pivoting slider 38 of the damper stop placed innermost on the profile 12. As a result, a single wall support 40, provided with two opposite and offset protruding appendages 56 and 58, can advantageously be used to activate the pivoting sliders of both damper stops 24, even if offset with respect to the profile 12.

As may be seen from the above, the advantages which the invention achieves are evident.

The sliding and braking device for sliding doors of the present invention allows a more effective damper braking of the doors 14 given the possibility of fully exploiting both the stroke of the piston stems of the pistons 26 and the extension of the coil spring 28, in any case while respecting the overall size of the damper stops 24; this is due to the fact that the damper stops are fixed to the profile 12 at an offset relative to each other.

A further advantage is the ability to use wall supports 40 of a single type provided with opposite and offset bevelled appendages 56, 58, which actuate the pivoting sliders 38 of the damper stops 24.

Despite the invention having been described above with reference to one of its possible embodiments, given solely by way of a non-limiting example, numerous modifications and variants will appear evident to a person skilled in the art in the light of the above description, also bearing in mind the fact that the device according to the invention, appropriately sized, may also be used with the sliding doors of wardrobes. The present invention therefore sets out to embrace all the modifications and variants which fall within the sphere and scope of the following claims.

The invention claimed is:

1. A device for supporting and braking a sliding door, said device comprising:

a profile fastened to a face of the sliding door, said profile having an upper, substantially U-shaped guide portion, a central vertical portion in abutment with the face of the sliding door, and a lower base portion extending substantially orthogonally from the central vertical portion;

two damper stops arranged on the base portion at opposite ends of the profile and offset relative to each other in a direction perpendicular to the central vertical portion, each damper stop comprising a frame, a piston, a coil spring and a pivoting slider, each of said pivoting sliders supported in a respective one of the frames for sliding movement along the frame and connected to a free end of a piston stem of a respective one of the pistons and to an end of a respective one of the coil springs, each of said pistons positioned atop a respective one of the coil springs in the frame; and a wall support having one or more wheels, said sliding door slidingly supported on the support via engagement of the one or more wheels in said guide portion, said wall support further comprising appendages arranged so that each of the appendages is aligned with the pivoting slider of a respective one of the two damper stops for engagement with the pivoting slider of the respective one of the two damper stops as the sliding door moves between opened and closed positions.

2. The device of claim 1, wherein the engagement of each of the appendages with the pivoting slider of the respective one of the damper stops causes the compression of the coil spring of the respective one of the damper stops.

3. The device of claim 1, wherein one of the damper stops is fixed on the base portion proximal to the central vertical portion of the profile, and the other one of the damper stops is fixed on the base portion distal to said central vertical portion.

4. The device of claim 1, wherein the wall support comprises a substantially rectangular reinforcement portion and a plate, said plate adapted for fastening the wall support to a wall with fasteners, said one or more wheels comprising two paired wheels provided on a side of the rectangular reinforcement portion facing the profile.

5. The device of claim 4, wherein the substantially rectangular reinforcement portion comprises opposing vertical sides each provided with one of the appendages, and wherein each of said appendages has a beveled shape.

* * * * *